US007024965B2

(12) United States Patent
Tremblay

(10) Patent No.: US 7,024,965 B2
(45) Date of Patent: Apr. 11, 2006

(54) SEMI-AUTOMATIC JAR OPENER

(76) Inventor: Donald Tremblay, 835. du Coteau. Ste-Fov., Quebec G1X 2P1 (CA)

( * ) Notice: Subject to any disclaimer, the term of this patent is extended or adjusted under 35 U.S.C. 154(b) by 0 days.

(21) Appl. No.: 09/974,513

(22) Filed: Oct. 11, 2001

(65) Prior Publication Data

US 2003/0070510 A1 Apr. 17, 2003

(51) Int. Cl.
*B67B 7/14* (2006.01)

(52) U.S. Cl. ..... 81/3.2; 81/3.37; 81/3.42; 81/3.32

(58) Field of Classification Search ..... 81/3.2, 81/3.25, 3.31–3.33, 3.36–3.37, 3.29, 3.39, 81/3.4, 3.42
See application file for complete search history.

(56) References Cited

U.S. PATENT DOCUMENTS

| | | | | |
|---|---|---|---|---|
| 2,897,699 | A * | 8/1959 | Anderson, Jr. | 81/3.32 |
| 3,795,158 | A * | 3/1974 | Morita | 81/3.32 |
| 5,430,923 | A * | 7/1995 | Parent et al. | 81/3.2 |
| 5,996,441 | A * | 12/1999 | Bateman | 81/3.2 |
| 6,182,534 | B1 * | 2/2001 | Hardman | 81/3.2 |
| 6,293,170 | B1 * | 9/2001 | Hajianpour | 81/3.2 |

FOREIGN PATENT DOCUMENTS

| | | |
|---|---|---|
| CA | 432070 | 12/1945 |

* cited by examiner

*Primary Examiner*—Debra S Meislin
(74) *Attorney, Agent, or Firm*—Fay Kaplun & Marcin, LLP

(57) ABSTRACT

The present disclosure is a semi-automatic jar opener made up of a lower part including a run button activating an electric motor mounted under the lower part, which allows a lower plate to turn and activate a gear rack allowing the lower jaws provided with non-skid rubber strips to squeeze a jar according to the desired size, when the jar turns the friction rubber strips prevent it from sliding, and when the jar is unscrewed the electric motor stops automatically.

The vertical jagged posts are mounted onto the lower part and engaged inside the apertures of an upper part including a base with an extension on which is mounted a shaft passing through gears and knobs, which in pulling on the knob including a locking means it allows to lower manually the upper part onto the posts, which includes an upper plate provided with the friction rubber strips pressing a lid and preventing it to slide, when the lower plate turns it allows automatically the jar and the upper plate to turn, which activates a gear rack allowing the upper jaws provided with non-skid rubber strips to squeeze the lid until the jar be unscrewed.

The extension of the base from the upper part allows the means locking to block the knob when the jar is removed from the semi-automatic jar opener.

16 Claims, 6 Drawing Sheets

SEMI-AUTOMATIC JAR OPENER

FIELD OF THE INVENTION

The present invention relates to a semi-automatic jar opener for opening a threaded cover of a jar of any size, without manually applying torsional force and exerting physical strength.

BACKGROUND INFORMATION

CA Patent No. 432,070 to Gaulin on Dec. 25$^{th}$ 1945 (hereinafter "Gaulin") shows a bottle and jar opener. However, Gaulin's jar opener is not semi-automatic and cannot be used by elders, who may have little or no physical strength, or handicapped persons, who may not be physically capable of using Gaulin's device. Gaulin requires the user to hold the jar or bottle in one of his hands, place the opener on top of the cover with his other hand, and twist his wrist counter-clockwise, manually applying a counter-clockwise torque to loosen and subsequently remove the threaded cover from any bottle or jar.

SUMMARY OF THE INVENTION

The present invention relates to a semi-automatic opener for a jar closed by a threaded cover. The opener includes:

- a first portion including a first body defining a base for receiving the jar thereon;
- a second portion including a second body mounted to the first body so as to be superimposed to the first body;
- one of the first and second portions having:
  - a first turntable rotatably mounted to the respective body between the first and second portions via a rotatable shaft for rotating at least one of the jar and the cover;
- a first toothed rack mounted to the first turntable; the first toothed rack having a first central gear coaxially mounted to the rotatable shaft and a first pair of rack elements each interlocked to the first central gear for reciprocating movement towards and away each other upon rotation of the first central gear; and
- first pair of immobilizing elements for immobilizing the at least one of the jar and the cover; each of the pair of immobilizing elements being secured to a respective rack element of the first toothed rack; and
- the other of the first and second portions being provided with second immobilizing elements mounted to the respective body for immobilizing the other of the at least one of the jar and the cover;
- whereby, in operation, the jar is positioned onto the based and its cover is immobilized by the second immobilizing elements; the rotatable shaft is then rotated causing the first pair of immobilizing elements to move towards each other until they grip the at least one of the jar and the cover; rotating the shaft then causes a torsional force between the jar and the cover so as to unlock the cover.

The device enables users, particularly elders and handicapped persons, to unscrew threaded covers of a jar. Thus, one of the benefits of the present invention is the user is not required to manually exert torsional force to unscrew a threaded cover from a jar. The rotational torque is provided by an electric motor and does not require the application of manual force. Users who have little or no physical strength, which is a common problem with the elderly, can utilize the present invention and unscrew threaded covers from jars without using physical strength. In addition, the present invention is user-friendly and may be operated by a single hand. Many handicapped users, who may have physical limitations, are also enabled by the present invention to unscrew threaded covers from jars without much difficulty. Furthermore, the present invention does not need to be fixed at a single location and may be moved from one place to another.

BRIEF DESCRIPTION OF THE DRAWINGS

FIG. 6 is a sectional view of an upper part of the jar opener illustrated in FIG. 1.

DETAILED DESCRIPTION

Figure 1:
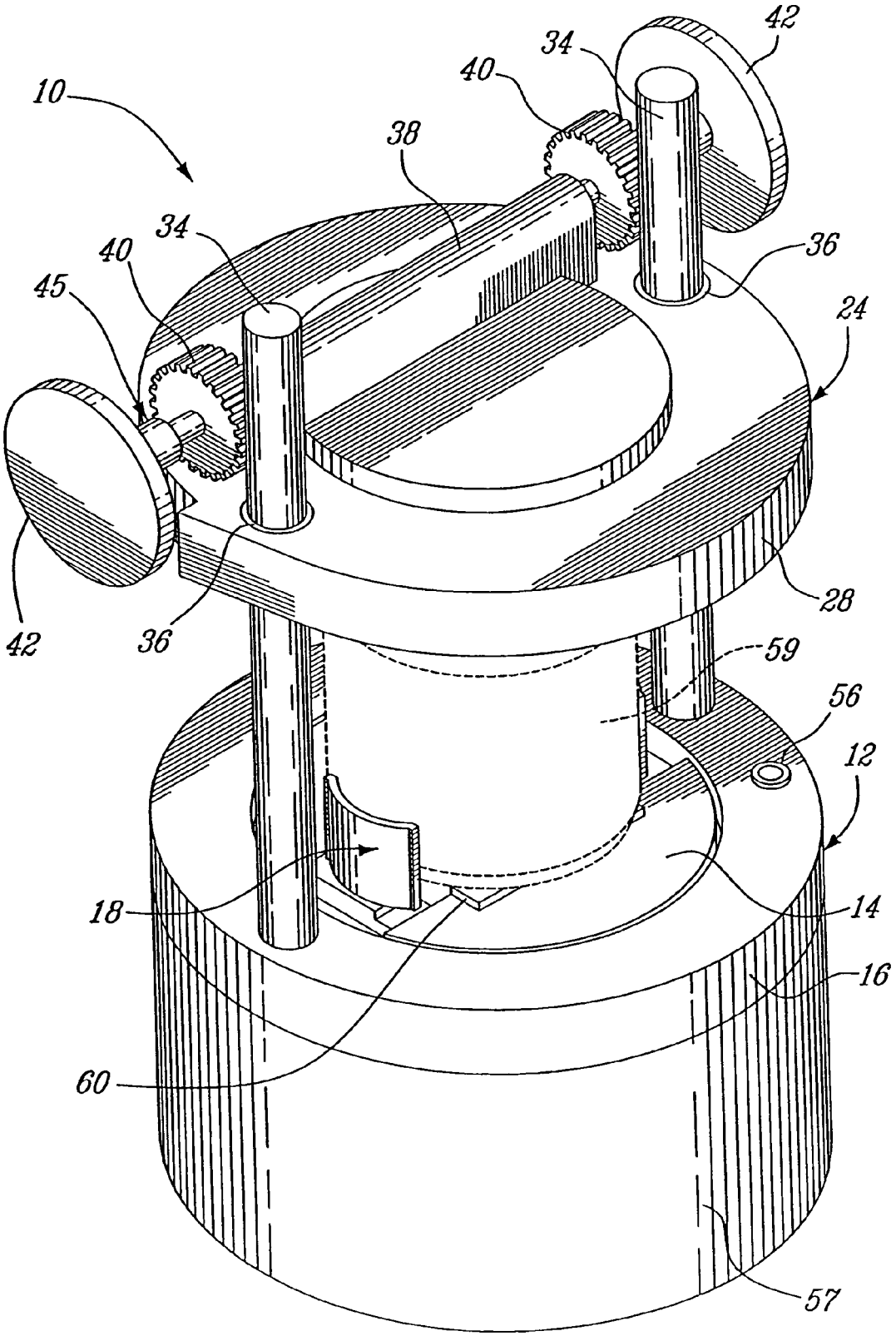
FIG. 1 is a top front perspective view of an exemplary embodiment of a semi-automatic jar opener according to the present invention.

An automatic jar opener 10 according to an exemplary embodiment of the present invention will now be described with reference to FIGS. 1 to 6.

The automatic jar opener 10 comprises a lower portion 12 including a lower turntable 14 rotatably mounted in a first disk-shape body 16, and lower immobilizing elements 18, operatively coupled to the lower turntable 14 via a first toothed rack 20. The lower turntable 14 is operatively coupled to an electric motor so as to be drivable therefrom.

The automatic jar opener 10 further comprises an upper portion 24 including an upper turntable 26 rotatably mounted in a second disk-shaped body 28, and upper immobilizing elements 30, operatively coupled to the upper turntable 26 via a second toothed rack 32.

The second disk-shaped body 28 is movably mounted to the first disk-shaped body preferably via two serrated posts 34 that are secured to the first disk-shaped body 16. The second disk-shaped body 28 includes two diametrically opposite apertures 36 configured, sized and positioned to coverably receive a respective serrated post 34.

The upper portion 24 is provided with a horizontal shaft 38 rotatably mounted to the second disk-shaped body 28 so as to be generally parallel to the flat surfaces thereof and as to have its two ends adjacent to a respective serrated post 34. Two gears 40 are mounted to the shaft 38 thereabout and are so positioned along the shaft 38 so as to interlock a respective serrated post 34. Each of the two ends of the shaft 38 is provided with a knob 42. The knobs 42 allow rotating the gears 40 of the horizontal shaft 38 for adjusting the height of the upper portion 24 along the serrated vertical posts 34 and therefore the distance between the upper and lower portions 12 and 24.

At least one knob 42 may include a radial projection 44 part of a locking mechanism 45 for preventing the rotation of the horizontal shaft 38 and therefore the translation of the upper portion 24 along the serrated posts 34. According to a specific embodiment of the present invention, the locking mechanism 45 further includes a second projection 46 extending tangentially from the second disk 28 adjacent one of the two posts 34 to be engage by the radial projection 44 of the knob 42. Of course, the shaft 38 is axially movable allowing positioned the first and second projections 44–46 for engagement thereof.

The lower portion 12 will now be described in more detail with reference to FIGS. 2–5. Each of the two lower immobilizing elements 18, in the form of a pair of jaws, is secured to an enlarged portion of a respective opposite rack element 47 of the toothed racks 20. The rack elements 47 are mounted to the lower turntable 14 for reciprocating towards and away each other. The lower toothed rack 20 further includes a central rotatable gear 48 interlocked with the two rack elements 47 so as to allow transforming the rotational movement of the motor 22 into a translation of the rack elements 47.

More specifically, the driving shaft 54 of the motor 22 is operatively coupled to centra gear 48 via a first coupling gear 50 fixedly secured to a first end of a shaft 51, which is rotatably mounted coaxially within the first disk-shaped hollow body 16 via a low friction cylindrical sleeve 53, and that has its other end secured to the gear 48. The first coupling gear 50 is interlocked with a second coupling gear 52, which is coaxially mounted to the driving shaft 54 of the motor 22. As illustrated in FIG. 1, the lower portion 12 of the opener 10 may sit on a hollow cylindrical base 57 that allows both supporting the opener 10 and protecting the motor 22 and first and second coupling gears 50 and 52. A run button connected to the motor 22 is provided to activate and deactivate the motor 22.

Figure 2:
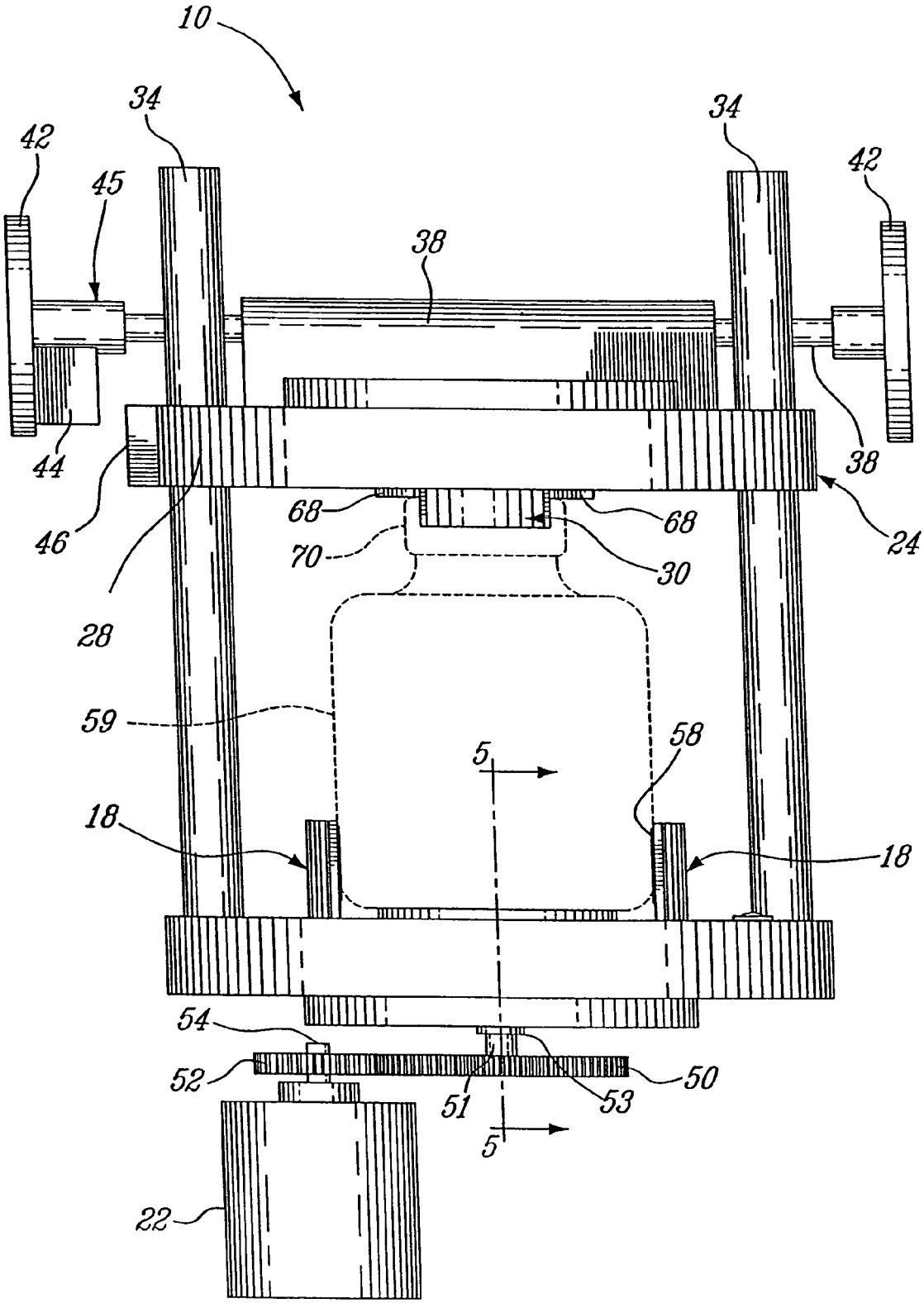
FIG. 2 is a front elevational view of the jar opener illustrated in FIG. 1.
Figure 3:
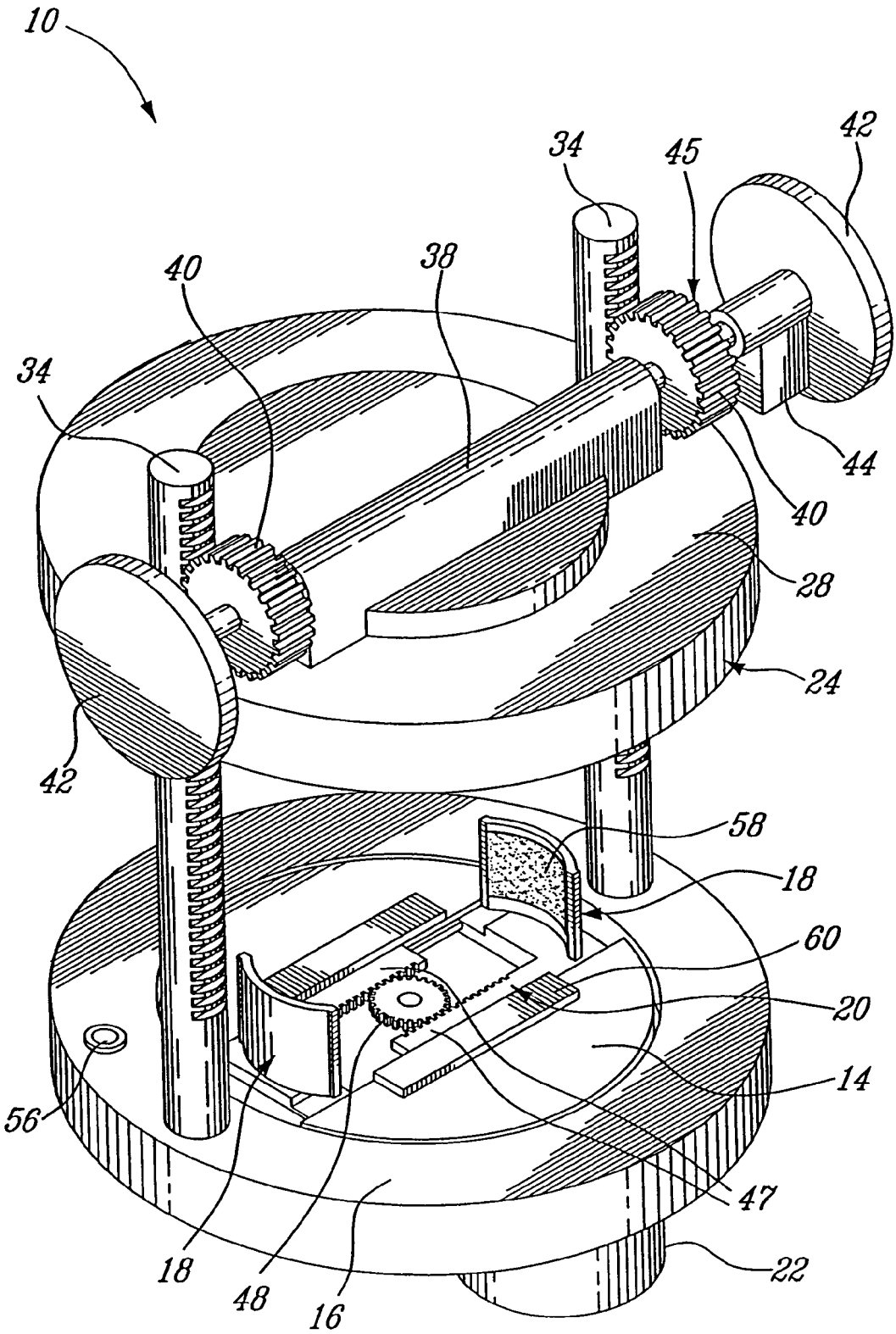
FIG. 3 is a top perspective view of a lower part of the jar opener illustrated in FIG. 1.
Figure 4:
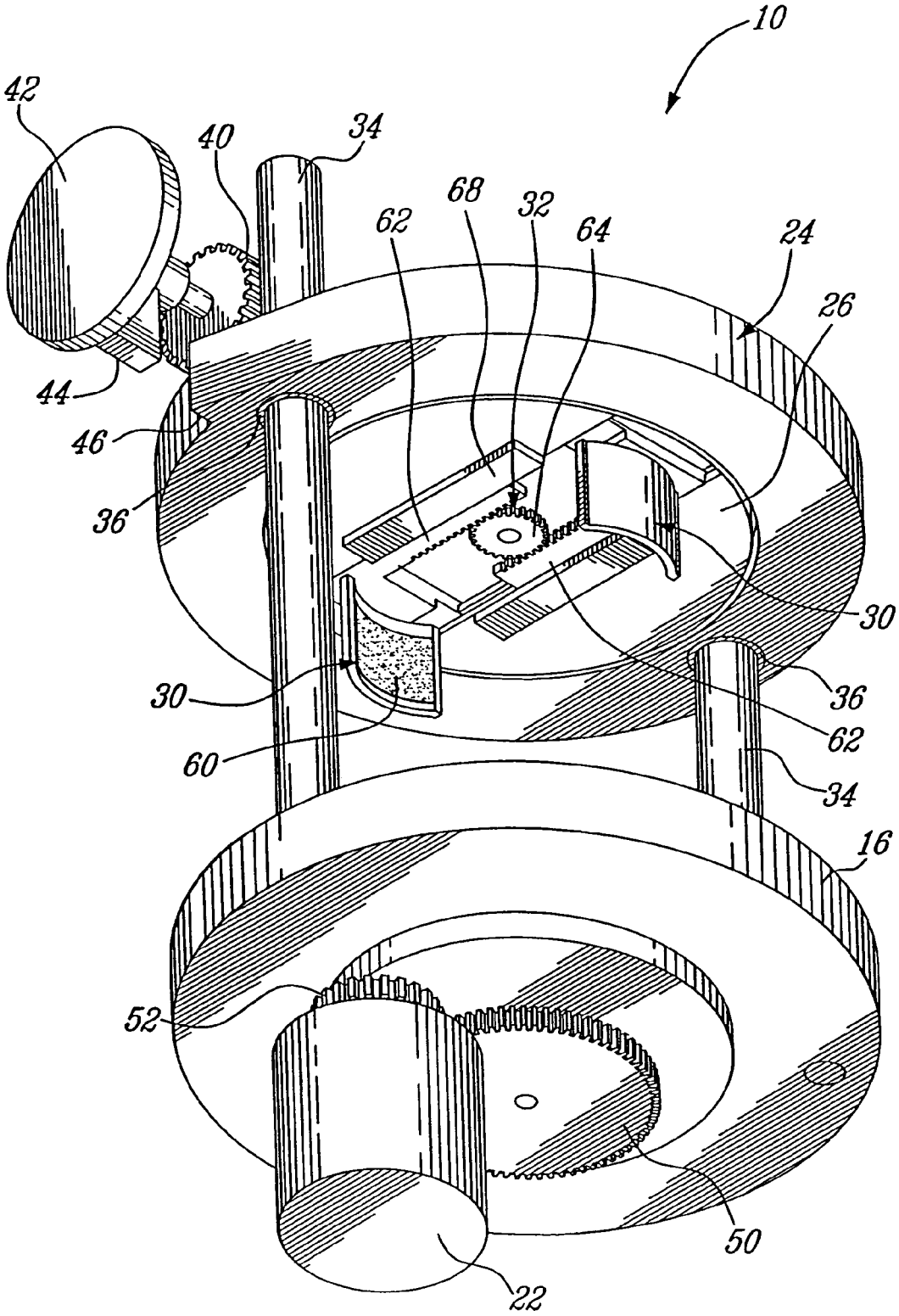
FIG. 4 is a bottom frontal perspective view of an upper part of the jar opener illustrated in FIG. 1.
Figure 5:
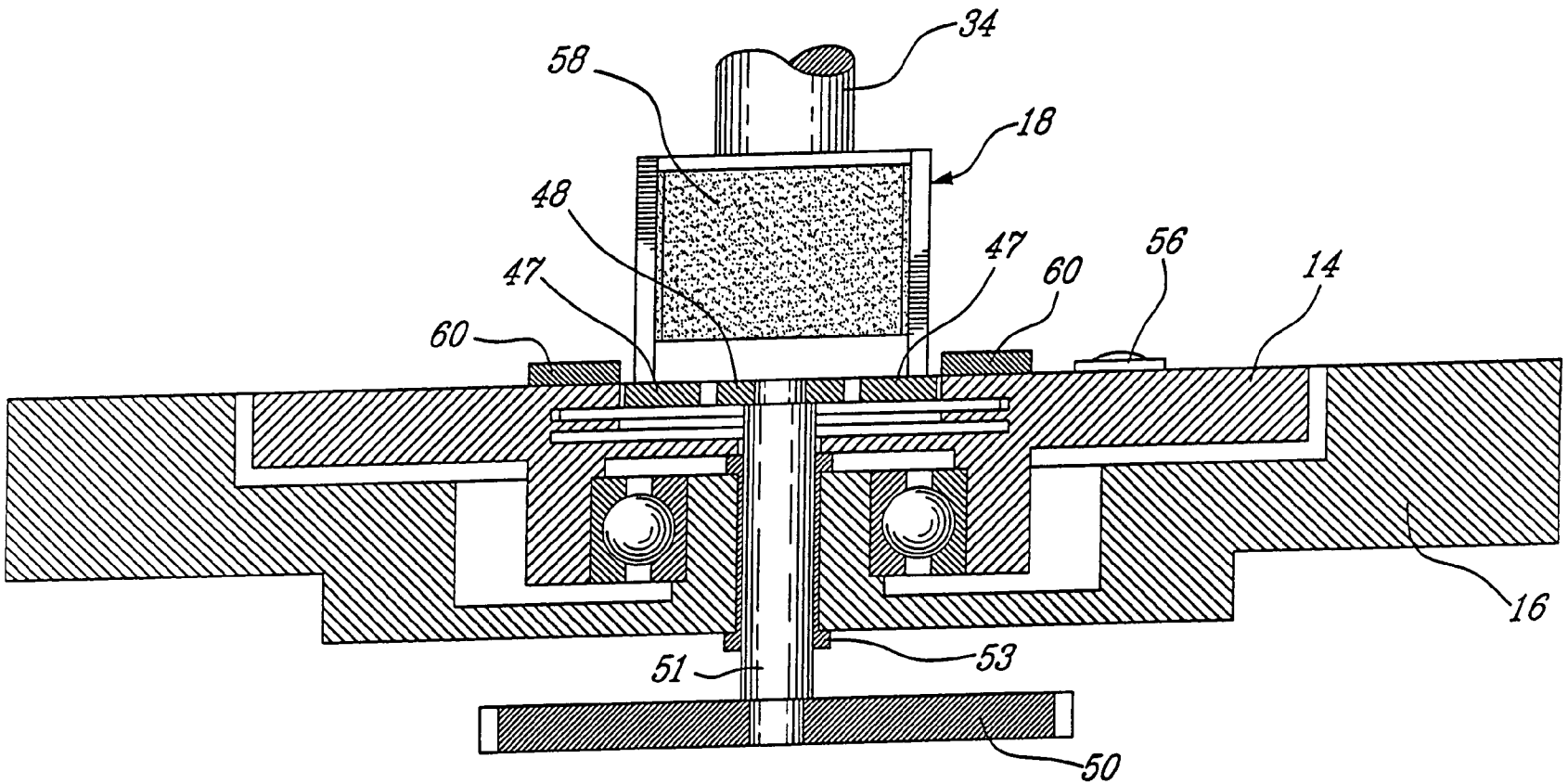
FIG. 5 is a sectional view taken along lines 5—5 on FIG. 2.
Figure 5:
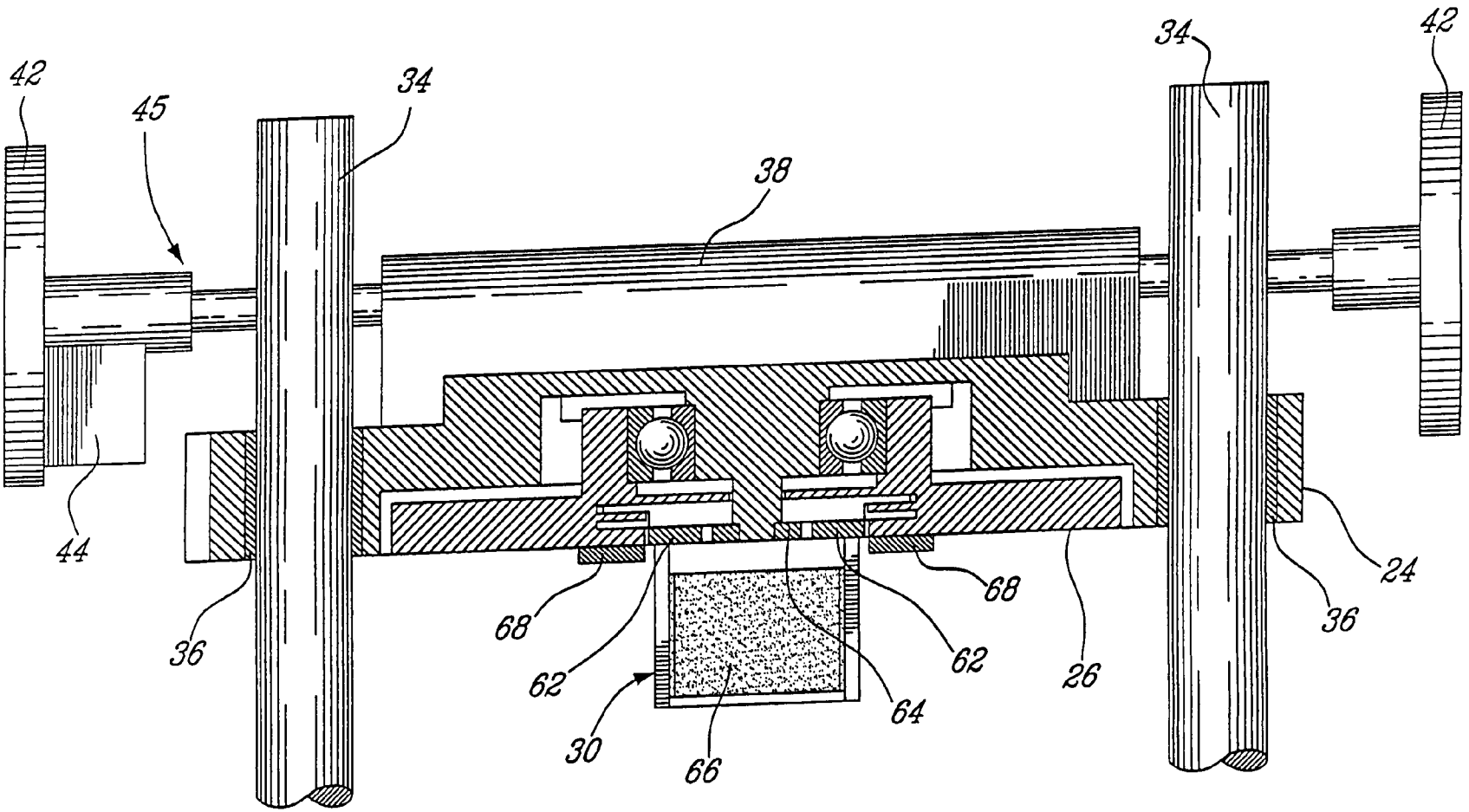

The upper portion 24 will now be described in more detail with reference to FIGS. 2, 4 and 6. Each of the two upper immobilizing elements 30, in the form of a pair of jaws, is secured to an enlarged portion of a respective opposite rack element 62 of the toothed rack 32. The rack elements 62 are mounted to the upper turntable 26 for reciprocation towards and away each other. The second toothed rack 32 further includes a central gear 64 interlocked with the two rack elements 62 therebetween.

In operation, the distance between the lower and upper portions 12 and 24 is adjusted to accommodate a jar 59 to open so that the upper turntable 26 contacts the top of the cover 70 of the jar 59. The distance is adjusted by first disengaging the locking mechanism 45 as explained hereinbelow and by rotating at least one of the knobs 42 so as to translate the upper portion 24 along the posts 34.

Then, activating the motor 22 causes the rotation of the central gear 48 of the lower turntable which in turn causes the rotation in unison of the lower turntable 14, the jar 59 and the upper turntable 26. Since the rotation of the upper turntable 26 causes the closing of the upper jaws 30 on the cover 70 of the jar 59, the rotation of the jar is stopped when the upper jaws 30 grip the cover 70. The jar 59 and the upper portion 24 of the jar opener are then immobilized while the lower jaws 18 move towards the jar 59 since the motor is still energized and the lower turntable 14 is mounted to the rotating shaft 51. The cover 70 being immobilized, the rotation of the jar 59 resulting in its opening.

Friction pads 68 can be provided on the lower and upper turntable 14 and 26 to help stabilize the jar 59 and also contribute to maximize the rotation of the upper turntable 26 in unison with the jar 59 when the upper portion 24 abuts the jar and the jaws 30 are not closed on the cover 70 of the jar 59. Friction pads 66 can also be provided on the jaws 30 for similar purposes. Similarly, the jaws 18 and 30 can be lined with respective friction material 58 and 66 to improve the gripping action on jar 59. Such friction material can be rubber for example.

It is to be noted that the opener 10 is operable with a single hand and a minimal force is required to execute the above operation.

As would be understood by one skilled in the art, the gears 50–52 may be rotated manually or electrically such that the movement of the gears increases/decreases the separation between the upper jaws 30. Once the motor 22 has been activated, the lower set of jaws 18 tighten to firmly grip the jar 59 and secure the jar 59 to the center of the platform while the electric motor 22 rotates the lower turntable 14. As the lower turntable 14 rotates, torque is applied to loosen and unscrew the threaded cover 70. It is to be noted that pressure ceases to be exerted on the jaws 18 and 30 as soon as the cover 70 is unlocked.

The present invention has been described with reference to specific exemplary embodiments thereof. It will, however, be evident that various modifications and changes may be made thereunto without departing from the broadest spirit and scope of the present invention as set forth in the claims that follow. The specification and drawings are accordingly to be regarded in an illustrative rather than restrictive sense.

I claim:

1. A semi-automatic opener for a jar closed by a threaded cover comprising:

a first portion including a first body defining a base for receiving the jar thereon;

a second portion including a second body mounted to said first body so as to be superimposed to said first body;

one of said first and second portions having:

a first turntable rotatably mounted to the respective body between said first and second portions via a rotatable shaft for rotating at least one of said jar and said cover; a first toothed rack mounted to said first turntable; said first toothed rack having a first central gear coaxially mounted to said rotatable shaft and a first pair of rack elements each interlocked to said first central gear for reciprocating movement towards and away each other upon rotation of said first central gear; and a first pair of immobilizing elements for immobilizing said at least one of said jar and said cover; each of said pair of immobilizing elements being secured to a respective rack element of said first toothed rack; and the other of said first and second portions being provided with second immobilizing elements mounted to the respective body for immobilizing the other of said at least one of said jar and said cover;

whereby, in operation, the jar is positioned onto said base and its cover is immobilized by said second immobilizing elements; said rotatable shaft is then rotated causing said first pair of immobilizing elements to move towards each other until they grip said at least one of said jar and said cover; rotating said shaft then causes a torsional force between said jar and said cover so as to unlock the cover.

2. A jar opener as recited in claim 1, wherein at least one of said first pair of immobilizing elements and said second immobilizing elements includes a pair of jaws.

3. A jar opener as recited in claim 1, wherein at least one of said first pair of immobilizing elements and said second immobilizing elements are lined with a friction material.

4. A jar opener as recited in claim 3, wherein said friction material is rubber.

5. A jar opener as recited in claim 1, wherein said first turntable includes at least one friction member.

6. A jar opener as recited in claim 5, wherein said at least one friction member is made of rubber.

7. A jar opener as recited in claim 1, further comprising a motor for driving said rotatable shaft.

8. A jar opener as recited in claim 7, wherein said motor is provided with a driving shaft; said rotatable shaft is coupled to said driving shaft via at least one coupling gear.

9. A jar opener as recited in claim 7, wherein said motor is operable through a button.

10. A jar opener as recited in claim 1, wherein said rotatable shaft is mounted to the respective one of said first and second bodies via a low-friction cylindrical sleeve.

11. A jar opener as recited in claim 1, wherein the other of said first and second portions being provided with a second turntable rotatably mounted to said second body and a second toothed rack mounted to said second turntable; said second toothed rack having a second central gear rotatably mounted to said second body and a second pair of rack elements each interlocked to said second central gear for reciprocating movement towards and away each other upon rotation of said second central gear; said second immobilizing elements include two immobilizing elements, each secured to a respective one of said second pair of rack elements whereby, in operation, rotating said rotatable shaft causes the rotation of the central gear of the first turntable which in turn causes the rotation in unison of the first turntable, the jar and said second turntable until second immobilizing elements grip on the cover.

12. A jar opener as recited in claim 11, wherein said second turntable includes at least one friction member.

13. A jar opener as recited in claim 12, wherein said at least one friction member is made of rubber.

14. A jar opener as recited in claim 1, wherein said second body is mounted to said first body via two serrated posts that are secured to said first body; said second body being provided with two apertures for receiving said posts; said second portion further comprising an horizontal shaft rotatably mounted to said second body and two gears, each coaxially mounted to said horizontal shaft so as to interlock with a respective serrated post; whereby, the rotating said horizontal shaft allows varying a distance between said first and second portions of the opener.

15. A jar opener as recited in claim 14, wherein at least one of two longitudinal ends of said horizontal shaft being provided with a knob.

16. A jar opener as recited in claim 15, wherein said knob and said second body are provided with respective first and second projections for preventing the rotation of the horizontal shaft, thereby locking the second body along the serrated posts.

* * * * *